United States Patent [19]

Burgess et al.

[11] Patent Number: 4,541,911

[45] Date of Patent: Sep. 17, 1985

[54] METHOD OF ASSEMBLING A FILTER PRESS TYPE ELECTROLYTIC CELL

[75] Inventors: Paul E. A. Burgess, Crowton; Colin Brereton, Middlewich, both of England

[73] Assignee: Imperial Chemical Industries plc, London, England

[21] Appl. No.: 628,566

[22] Filed: Jul. 6, 1984

[30] Foreign Application Priority Data

Jul. 19, 1983 [GB] United Kingdom ..... 8319492

[51] Int. Cl.[4] ..... C25B 9/02; C25B 15/00

[52] U.S. Cl. ..... 204/253; 204/279; 204/297 R

[58] Field of Search ..... 204/253–258, 204/279, 297 R

[56] References Cited

U.S. PATENT DOCUMENTS

| | | | |
|---|---|---|---|
| 3,875,040 | 4/1975 | Weltin et al. | 204/254 X |
| 3,926,770 | 12/1975 | Hoekje | 204/255 X |
| 4,032,423 | 6/1977 | Cunningham | 204/256 X |
| 4,309,264 | 1/1982 | Bender et al. | 204/258 X |
| 4,311,577 | 1/1982 | Kircher | 204/255 |
| 4,430,179 | 2/1984 | Ford et al. | 204/255 X |

FOREIGN PATENT DOCUMENTS

| | | |
|---|---|---|
| 0038445 | 10/1981 | European Pat. Off. . |
| 0058238 | 8/1982 | European Pat. Off. . |
| 0072468 | 2/1983 | European Pat. Off. . |

*Primary Examiner*—Donald R. Valentine

*Attorney, Agent, or Firm*—Cushman, Darby & Cushman

[57] ABSTRACT

A method of assembling an electrolytic cell of the filter press type comprising a plurality of anodes, cathodes, gaskets of an electrically insulating material, and separators, in which the electrolytic cell is assembled on a jig comprising a support unit having removably affixed thereto a plurality of substantially horizontally disposed support members positioned to at least one side of said unit, and preferably to both sides of said unit, the method comprising positioning anodes, cathodes and gaskets on said horizontally disposed support members with a separator positioned between an adjacent anode and cathode, removing the support unit, and compressing the thus formed assembly of anodes, cathodes, gaskets and separators on the horizontally disposed support members to form the electrolytic cell.

14 Claims, 12 Drawing Figures

METHOD OF ASSEMBLING A FILTER PRESS TYPE ELECTROLYTIC CELL

This invention relates to a method of assembling an electrolytic cell of the filter press type.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for charging electrolyte to the cell, suitably from a common header, and with means for removing products of electrolysis from the cell. Similarly, the cathode compartments of the cell are provided with means for removing products of electrolysis from the cell, and optionally with means for charging water or other fluids to the cell, suitably from a common header. Such electrolytic cells may be of the monopolar or bipolar type, and generally comprise one or more gaskets of an electrically insulating material positioned between adjacent anodes and cathodes so as to electrically insulate the adjacent anodes and cathodes.

Electrolytic cells comprising a large number of alternating anodes and cathodes, for example, fifty anodes alternating with fifty cathodes arranged in the form of a filter press, have been developed in recent years. Such electrolytic cells may comprise even more anodes and cathodes, for example up to one hundred and fifty alternating anodes and cathodes.

In recent years electrolytic cells of the filter press type have been developed for use in the production of chlorine and aqueous alkali metal hydroxide solution by the electrolysis of aqueous alkali metal chloride solution, particularly cells in which the separator is a substantially hydraulically impermeable cation-exchange membrane. Where aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with water are removed from the cathode compartments of the cell.

Assembly of such electrolytic cells comprising a large number of anodes, cathodes, separators, and gaskets of an electrically insulating material, presents some difficulties. Although such electrolytic cells are generally used with the cell horizontally disposed, that is with the anodes, cathodes, separators and gaskets positioned vertically, assembly of the electrolytic cell in such a horizontally disposed position presents some difficulties. It is difficult to position the component parts of the cell accurately with respect to each other when these component parts are assembled in a vertical manner, and in particular it is difficult to position the separators accurately in relation to the anodes, cathodes and gaskets.

An obvious way to overcome this difficulty is to assemble the cell in a vertical mode, that is to position the anodes, cathodes, separators, and gaskets horizontally and thus to build up a vertical stack, and when the cell has been thus assembled, to turn the stack through 90° so that the cell is positioned horizontally, with the anodes, cathodes, gaskets and separators positioned vertically.

Such a method of assembly of an electrolytic cell of the filter press type has been the subject of published patent applications. For example, in European Patent Publication No. 0 038 445 there is described a method of assembling a monopolar filter press type electrolytic cell, which method comprises (a) assembling a vertical stack of horizontal electrode frames with a horizontal membrane sheet between each pair of opposed frames;
(b) preconditioning said vertical stack by passing moist, warm fluid through said stack,
(c) applying pressure to opposite vertical ends of said stack so as to vertically compress said vertical stack,
(d) rotating said compressed vertical stack from a vertical orientation to a horizontal orientation,
(e) connecting said vertically assembled, rotated, horizontal stack into an electrical circuit and to raw material supply lines and product withdrawal lines, and
(f) electrolytically operating said vertically assembled horizontal stack while maintaining said stack in said horizontal orientation.

In said patent publication there is also described a method of assembling a monopolar filter press-type electrolytic cell having a predetermined number of electrode frames and a predetermined number of membrane sheets the method comprising the steps of:

(a) assembling in a vertical stack the predetermined plurality of electrode frames, the frames being oriented horizontally with a horizontal membrane sheet interposed between each pair of opposing electrode frames,
(b) uniformly applying pressure to opposite vertical ends of said stack so as to vertically compress said stack,
(c) rotating said compressed vertical stack from a vertical orientation to a horizontal orientation,
(d) connecting said vertically assembled, rotated, horizontal stack into an electrical circuit and to raw material supply lines and product withdrawal lines, and
(e) electrolytically operating said vertically assembled horizontal stack while maintaining said stack in said horizontal orientation.

In European Patent Publication No. 0 058 238 there is described a method of assembling a monopolar filter press-type electrolytic cell having a plurality of generally planar electrodes appropriately mounted to electrode frames with ion-selective permeable membrane sheets interposed between each adjacent pair of electrodes, which comprises the steps of:

(a) placing a first end frame on a generally horizontal supporting structure,
(b) treating the membrane sheets with a hydrolysing fluid,
(c) placing a first cathode frame onto said first end frame, said first cathode frame being oriented generally horizontally,
(d) placing a first of said membrane sheets onto said generally horizontally oriented cathode frame, said first membrane sheet being oriented generally horizontally thereacross,
(e) placing a first anode frame onto said first membrane sheet, said first anode frame being oriented generally horizontally, (f) placing a second membrane sheet onto said first anode frame, said second membrane sheet being oriented generally horizontally thereacross, (g) placing a second cathode frame onto said second membrane sheet, said second cathode frame being oriented generally horizontally thereon, (h) repeating steps d-g a predetermined number of times until the desired number of anode and cathode frames are stacked in a generally vertical stack atop the generally horizontal supporting structure, (i) placing a second end frame atop said generally vertical stack of frames, (j) vertically compressing said generally vertical stack of frames into a compressed state, (k) securing retainers to said generally vertical stack of frames to retain said generally vertical stack of frames in said compressed state, and (l) rotating said generally vertical compressed stack of generally horizontal frames and membranes to an operating position wherein the frames and membranes are oriented generally vertically.

Assembly of the component parts of a filter press type electrolytic cell in a vertical stack presents some undesirable features. Thus, failure to position the anodes and/or cathodes in a precisely horizontal position leads to distortion, for example, of the gaskets positioned between adjacent anodes and cathodes, particularly when the stack is compressed. Also, where the electrolytic cell is a monopolar cell, the heavy copper members associated with each anode and cathode and through which the anodes and cathodes are attached to bus-bars, may cause the anodes and cathodes to sag and to deviate from a horizontal position. The separators positioned between adjacent anodes and cathodes, particularly those in the lower part of the vertical stack, are subject to the mass of the majority of the anodes and cathodes in the stack and there is a substantial risk of distortion or even irreparable damage to the separators occurring. Turning of the vertical stack through 90° to a horizontal position may also cause damage to the electrolytic cell.

The present invention relates to a method of assembling an electrolytic cell of the filter press-type in which method the cell is assembled in a horizontal mode in which the difficulties associated with assembly in such a mode are overcome, and which is not subject to the problems associated with assembly in a vertical mode.

According to the present invention there is provided a method of assembling an electrolytic cell of the filter press type comprising a plurality of anodes, cathodes, gaskets of an electrically insulating material, and separators, in which method the electrolytic cell is assembled on a jig comprising a support unit having removably affixed thereto a plurality of substantially horizontally disposed support members positioned to at least one side of said unit, the method comprising positioning anodes, cathodes and gaskets on said horizontally disposed support members with a separator positioned between an adjacent anode and cathode, removing the support unit, and compressing the thus formed assembly of anodes, cathodes, gaskets and separators on the horizontally disposed support members to form the electrolytic cell.

In the method of the invention the support unit, will in general be vertically disposed. The support unit will hereafter in general be referred to as a support plate, although it is to be understood that this support unit may have forms other than a plate. Also, the horizontally disposed support members will in general be referred to as tie rods. The tie rods may be affixed to the support plate by any convenient means provided that the support plate may readily be removed when required. The tie rods may for example be held in clamps on the support plate, e.g. in notched clamping blocks.

Assembly of the electrolytic cell in the aforedescribed horizontal mode offers a number of advantages, particularly when compared with assembly in a vertical mode. Thus, the anodes and cathodes are disposed vertically and the weight of the copper members associated therewith does not lead to distortion; the anodes and cathodes are positioned on the tie-rods which bear the weight of the anodes and cathodes thus eliminating distortion and possible damage caused by the weight of the anodes and cathodes in a vertical stack; there is a much reduced chance of damage to the separators as the separators do not have to bear the weight of the anodes and cathodes which is present in a vertical stack; and a more controlled compression of the horizontal stack may be effected when compared with that achievable with a vertical stack, in the latter case the weight of the stack itself exerting a substantial degree of compression, particularly on the anodes, cathodes, gaskets and separators in the lower part of the vertical stack. Furthermore, the accuracy of the relative positioning of the component parts of the electrolytic cell may be significantly improved.

The method of the present invention may be applied to the assembly of electrolytic cells of both the monopolar and bipolar type. In an electrolytic cell of the monopolar type at least one gasket of an electrically insulating material and a separator are positioned between each adjacent anode and cathode. In an electrolytic cell of the bipolar type a gasket of an electrically insulating material and a separator are positioned between the anode of an anode/cathode bipolar electrode and the adjacent cathode of an anode/cathode bipolar electrode.

The separator in the electrolytic cell may be of the hydraulically permeable porous diaphragm type, or it may be of the substantially hydraulically impermeable cation-permselective membrane type.

In assembling an electrolytic cell of the filter press-type in a vertical mode the separators may be maintained in position merely by laying the separators on top of the gaskets and/or the anodes and/or the cathodes. In the method of the present invention the electrolytic cell is assembled in a horizontal mode, with the anodes, cathodes, gaskets, and separators positioned in a vertical mode, and it is essential to provide some means of maintaining the separators in position during assembly of the cell. The separators may, for example, be held in position or sandwiched between two adjacent gaskets during the assembly. However, it is much preferred to affix the separators to the gaskets and/or the anodes and/or the cathodes in order to maintain the separators in position in the cell during assembly.

Affixing of the separators may be effected in several ways. An adhesive may be applied to the separator and/or to the gasket and/or to the anode and/or the cathode in order that the separator may be affixed thereto. The adhesive may suitably be a pressure sensitive adhesive. The separator may be draped over the gasket and/or the anode and/or the cathode and positioned on both sides thereof. The gasket and/or the anode and/or the cathode may have projections thereon to which the separator may be attached, or the separator may be stapled to the gasket, and/or to the anode and/or to the cathode, but conveniently to the gasket. Where staples are used it is desirable to use staples of an electrically insulating material, e.g. of a rigid plastics material. In general the separator will be affixed to the gasket.

Affixing of the separator need be such as merely to maintain the separator in position during assembly of the component parts of the electrolytic cell, as, after compression of the component parts, the separator is maintained in position by the compressive force applied to the component parts.

In the method of the invention the anodes, cathodes and gaskets are positioned on the tie rods of the jig. The anodes and cathodes may be in the form of plates and the anodes and cathodes, and optionally the gaskets, may have aperatures therein and they may be positioned on the tie rods via the apertures. Alternatively, the anodes, cathodes, and optionally the gaskets, may be affixed to apertured members which project from the anodes, cathodes, and optionally from the gaskets, in the plane thereof, and the apertured members may be positioned on the tie rods.

In a preferred embodiment of the invention, which aids assembly of the electrolytic cell, the gaskets are affixed to the anodes and/or to the cathodes, for example by means of suitable projections and mating recesses on the gaskets and on the anodes and/or the cathodes. An advantage of this preferred embodiment is that a pre-assembled combination of anode and gasket(s) and/or cathode and gasket(s) may be positioned on the tie rods. Indeed, a pre-assembled combination of anode, gasket and separator, and/or cathode, gasket and separator may be positioned on the tie rods.

In a further preferred embodiment of the invention the jig comprises a plurality of horizontally disposed support members positioned to both sides of a vertically disposed support unit, that is tie rods are disposed to both sides of a vertically disposed support plate. Preferably the tie rods are disposed such that each tie rod is continuous and is removably attached to the support plate and projects to both sides of the support plate. By use of such a preferred form of jig it is possible to assemble an electrolytic cell simultaneously on both sides of the support plate of the jig, or simultaneously to assemble two separate electrolytic cells, one on one side of the support plate and the other on the opposite side of the support plate. A further advantage of this method of assembly is that the weight of the component parts of the electrolytic cell to one side of the support plate compensates for the weight of the component parts of the electrolytic cell to the other side of the support plate.

An end plate may first be positioned on the tie rods on one side of the support plate, the anodes, cathodes, gaskets and separators may be positioned as hereinbefore described, another end plate may be positioned on the tie rods as described, the support plate may be removed from the jig, and the assembly of anodes, cathodes, gaskets and separators may be compressed on the tie rods between the end plates to form the electrolytic cell. In the case where an electrolytic cell is assembled on both sides of the support plate of the jig end plates may finally be positioned on the tie rods, the support plate may be removed from the jig, and the assembly of anodes, cathodes, gaskets and separators may be compressed between the pair of end plates to form a single electrolytic cell. Compression may be effected for example by means of capstans positioned on screw-threaded ends of the tie rods. Where assembly of two separate electrolytic cells is effected on tie rods on both sides of the support plate end plates will first be positioned on the tie rods and, after assembly of the anodes, cathodes, gaskets and separators, assembly will be completed by positioning of end plates on the tie rods.

The anodes in the electrolytic cell may be metallic, and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode portion of the anode may be positioned centrally and may comprise a plurality of elongated members, which are preferably vertically disposed, for example in the form of louvres or strips, or it may comprise a foraminate surface such as mesh, expanded metal or a perforated surface. The anode portion may comprise a pair of spaced apart foraminate surfaces disposed substantially parallel to each other, or two groups of elongated members spaced apart from each other, attached to a peripheral support, and the anode may thus be of a box-like form.

The anode portion of the anode may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. In the case where aqueous alkali metal chloride solution is to be electrolysed especially suitable electro-catalytically active coatings include those based on ruthenium dioxide/titanium dioxide, ruthenium dioxide/tin dioxide, and ruthenium dioxide/tin dioxide/titanium dioxide.

Such coatings, and methods of application thereof, are well known in the art.

The cathodes in the electrolytic cell may be metallic, and the nature of the metal will also depend on the nature of the electrolyte to be electrolysed in the electrolytic cell. Where an aqueous solution of an alkali metal chloride is to be electrolysed the cathode may be made, for example of, steel, copper, nickel or copper- or nickel-coated steel.

The cathode portion of the cathode may be positioned centrally and may comprise a plurality of elongated members, which are preferably vertically disposed, for example in the form of louvres or strips, or it may comprise a foraminate surface such as mesh, expanded metal or perforated surface. The cathode portion may comprise a pair of spaced apart foraminate surfaces disposed substantially parallel to each other, or it may comprise two groups of elongated members spaced apart from each other attached to a peripheral support, and the cathode may thus be of box-like form.

The cathode portion of the cathode plate may carry a coating of a material which reduces the hydrogen overvoltage at the cathode when the electrolytic cell is used in the electrolysis of water or aqueous solutions, e.g. aqueous alkali metal choride solution. Such coatings are known in the art.

The anodes and cathodes may be provided with means for attachment to a power source. For example, they may be provided with copper members which are suitable for attachment to appropriate bus-bars.

The anodes and/or the cathodes may be flexible, and they may be resilient, as flexibility and resiliency assists in the production of leak-tight seals when the anodes and cathodes are assembled into an electrolytic cell.

The thickness of the metal of the anodes and cathodes is suitably in the range 0.5 mm to 3 mm.

In the case where the electrolytic cell is monopolar it is preferred that the dimensions of the anodes and cathodes in the direction of current flow are such as to provide short current paths which in turn ensure low voltage drops in the anodes and cathodes without the use of elaborate current carrying devices. A preferred dimension in the direction of current flow is in the range 15 to 60 cm.

The electrolytic cell comprises a plurality of gaskets of electrically insulating material which electrically insulate each anode from the adjacent cathodes. The gasket is desirably flexible and preferably resilient and it should be resistant to those liquors in the cell with which it comes into contact. For example, in the case where the cell is to be used to electrolyse an aqueous solution of alkali metal chloride the gasket should be resistant to corrosion by wet chlorine, by chlorinated aqueous alkali metal chloride solution, and by concentrated aqueous alkali metal hydroxide solution. The gasket may be made of an organic polymer, for example a polyolefin, e.g. polyethylene or polypropylene; a hydrocarbon elastomer, e.g. an elastomer based on ethylene-propylene copolymers or ethylene-propylene-diene copolymers, natural rubber, or styrene-butadiene rubber; or a chlorinated hydrocarbon, e.g. polyvinyl chloride or polyvinylidene chloride. The gasket may be a fluorinated polymeric material, for example polytetrafluoroethylene, polyvinyl fluoride, polyvinylidene fluoride, or a tetrafluoroethylene-hexafluoropropylene copolymer, or a substrate having an outer layer of such a fluorinated polymeric material.

The gaskets may have a frame-like structure with a central opening which in the cell forms a part of the electrode compartment.

Where the separator to be used in the electrolytic cell is a hydraulically permeable microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the microporous diaphragm is made of polytetrafluoroethylene, although other materials which may be used include, for example, tetrafluoroethylene-hexafluoropropylene copolymers, vinylidene fluoride polymers and copolymers, and fluorinated ethylene-propylene copolymers.

Suitable microporous diaphragms are those described, for example, in UK Pat. No. 1503915 in which there is described a microporous diaphragm of polytetrafluoroethylene having a microstructure of nodes interconnected by fibrils, and in UK Pat. No. 1081046 in which there is described a microporous diaphragm produced by extracting a particulate filler from a sheet of polytetrafluoroethylene. Other suitable microporous diaphragms are described in the art.

Where the separator to be used in the electrolytic cell is a hydraulically impermeable cation-permselective membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Pat. Nos. 1184321, 1402920, 14066673, 1455070, 1497748, 1497749, 1518387, and 1531068.

In the electrolytic cell the electrolyte may be charged from a common header to the individual anode compartments of the cell, and the products of electrolysis may be removed from the individual anode and cathode compartments of the cell by feeding the products to common headers. The means of charging the electrolyte and removing the products of electrolysis may be separate pipes leading from separate common headers to each anode and cathode compartment of the electrolytic cell.

Alternatively, and in a preferred embodiment, the electrolytic cell of the invention may be formed from a plurality of anodes, cathodes, and gaskets, and the gaskets and/or the anodes and/or the cathodes may comprise a plurality of openings therein which in the cell together form a plurality of channels lengthwise of the cell which serve as the headers. In such a cell the means of charging the electrolyte and of removing the products of electrolysis may be passageways in the walls of the gaskets and/or of the anodes and/or cathodes which connect the headers to the anode and cathode compartments of the electrolytic cell.

The openings in the anodes, cathodes and gaskets may be positioned near the peripheries thereof.

The separator may if necessary, also comprise a plurality of such openings which in the cell form a plurality of channels lengthwise of the cell. Alternatively, the separator, which is positioned between an anode and a gasket, or a cathode and a gasket, or between a pair of gaskets, may be of a size such that it does not project over the openings in the anode, cathode and gasket, so that there is no necessity for it to have such openings therein.

The gasket, which may comprise a central opening defined by a frame-like section, may comprise the aforesaid openings in the frame-like section of the gasket. Similarly, the anode, or the cathode, may comprise a frame-like plate section, with the anode portion, or the cathode portion, positioned within and attached to the frame-like section. The aforesaid openings may be positioned in the frame-like section of the anode and/or of the cathode.

The gaskets and the anodes and/or the cathodes may comprise four such openings which in the electrolytic cell from a part of lengthwise channels which serve as headers. Thus, the electrolytic cell may comprise four such lengthwise channels which are respectively for supply of electrolyte, e.g. aqueous alkali metal chloride solution, to the anode compartments; for supply of other fluid, e.g. water, to the cathode compartments; for removal of electrolysis products, e.g. aqueous alkali metal chloride solution and chlorine, from the anode compartments; and for removal of products of electrolysis, e.g. aqueous alkali metal hydroxide solution and hydrogen, from the cathode compartments.

Where the anodes and/or the cathodes comprise openings which in the electrolytic cell form a part of the lengthwise channels forming the headers it is necessary to ensure that the lengthwise channels which are in communication with the anode compartments of the cell are insulated electrically from the lengthwise channels which are in communication with the cathode compartments of the cell. This electrical insulation may be achieved be means of frame-like members of electrically insulating material inserted in the openings in the anodes and cathodes which form a part of the lengthwise channels.

BRIEF DESCRIPTION OF THE DRAWINGS

The invention is illustrated by the following drawings in which

Referring to FIG. 1 there is shown an anode (1) made of titanium the working surface of which may have a coating of an electrolytically active electroconducting material. The anode comprises four apertures (2, 3, 4, 5) disposed in pairs to either side of the working surface of the anode (not shown). When the anode is assembled into the electrolytic cell these apertures form a part of lengthwise compartments which serve as headers for, respectively, electrolyte to be charged to the anode compartments of the cell, liquid and gaseous products to be removed from the anode compartments of the cell, water or other fluid to be charged to the cathode compartments of the cell, and liquid and gaseous products to be removed from the cathode compartments of the cell. Such fluids are passed to or from the headers to the anode and cathode compartments by means of passageways (not shown) in the walls of the anode. The anode (1) also comprises a lower extension (6) to which a copper member (7) is fixed, for example, by bolting thereto, and through which a connection may be made to a bus-bar. Two gaskets (8, 9) of an elastomeric electrically-insulating material are positioned on either side of the anode (1). Each gasket has a central aperture (not shown) and two pairs of apertures positioned on either side of the central aperture, and corresponding in position to the positions of the apertures (2, 3, 4, 5) in the anode (1). The gaskets (8, 9) may be positioned on and fixed to the anode (1) by means of projections and/or recesses on or in a face of the gasket which mate with corresponding recesses and/or projections on or in a face of the anode, as described in European Patent Publication No. 0080287. A sheet of a cation-exchange membrane (10, 11) is positioned on each of the gaskets (8, 9) over the central aperture therein and the sheets of cation-exchange membrane are fixed to the gaskets by means of a plurality of staples (12) of an electrically insulating plastics material.

Figure 1:
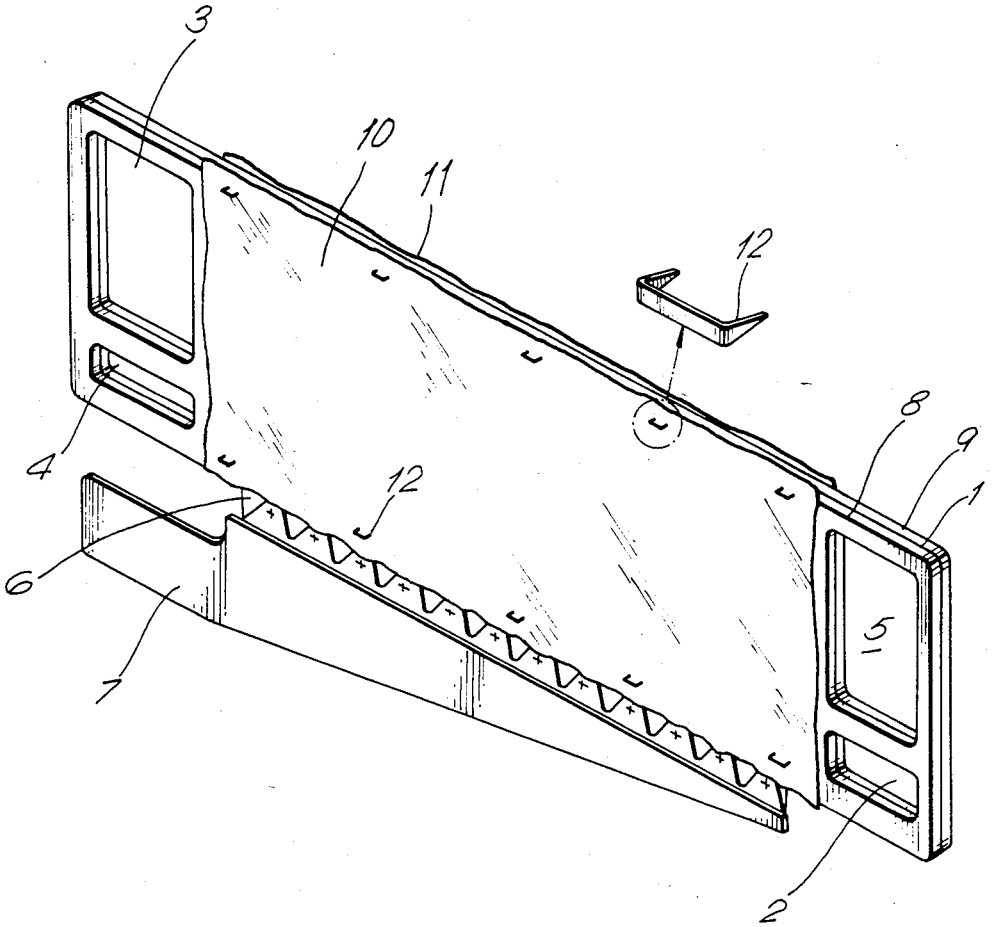
FIGS. 1 to 3 each show an isometric view of a monopolar electrode and a pair of associated gaskets, and, respectively different methods of fixing membrane to the gaskets, and FIGS. 4 to 12 each show isometric views illustrating the method of assembly of a monopolar electrolytic cell.
Figure 2:
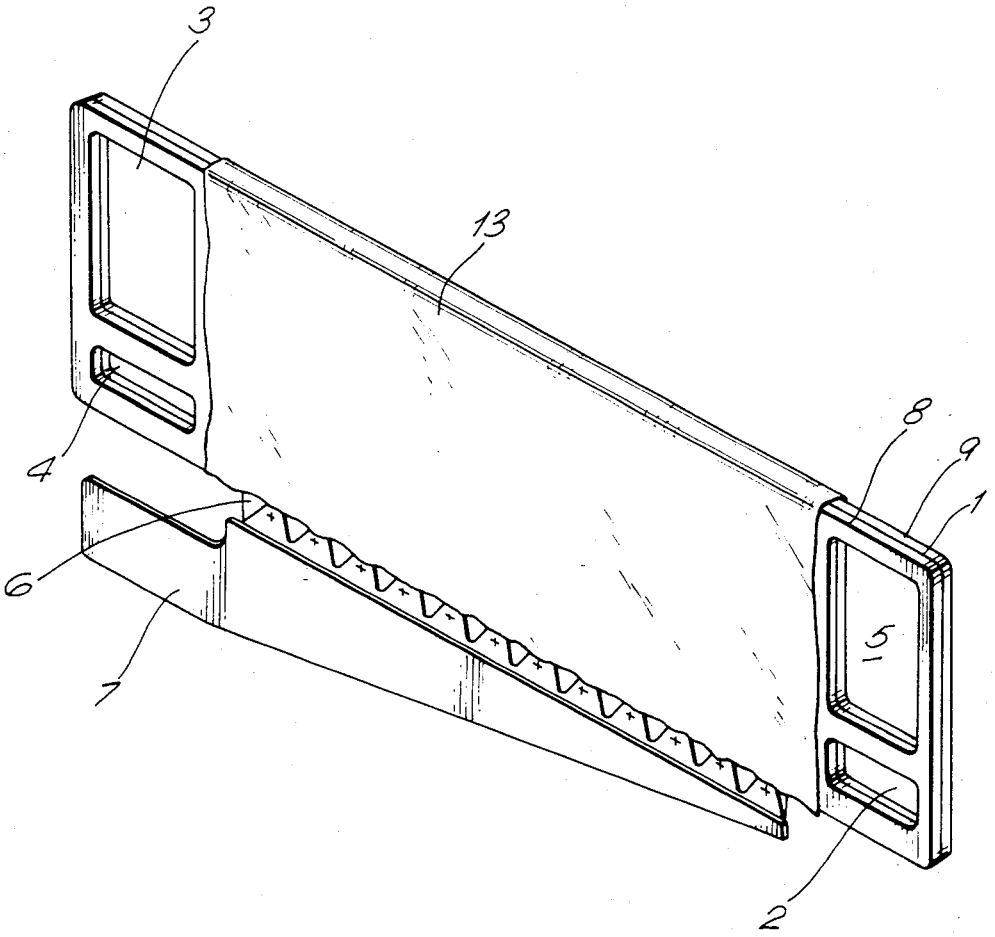
Figure 3:
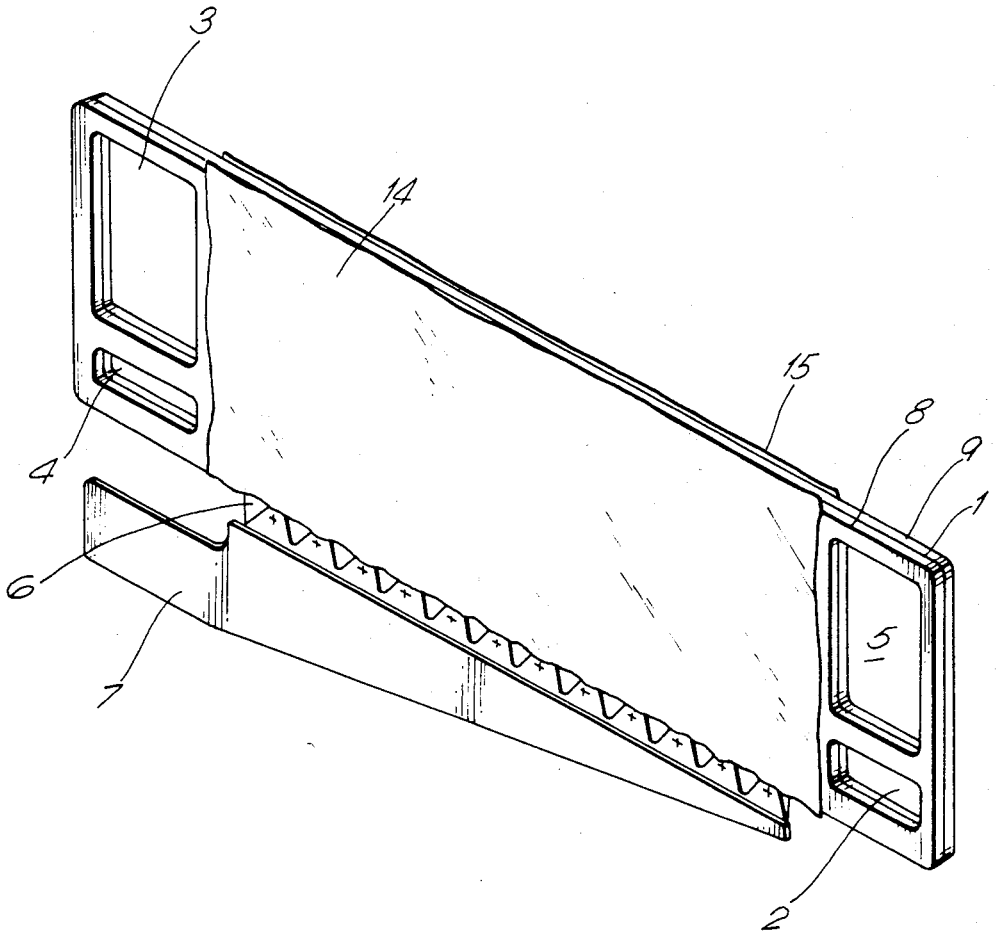

A cathode is not shown in FIGS. 1 to 3. It is to be understood that a cathode will have the same shape as the anode illustrated in FIGS. 1 to 3, and will similarly be associated with a pair of gaskets. The cathode differs from the anode in that in the cathode an extension corresponding to the extension (6) of the anode is positioned at the top of the cathode, as is a copper member fixed to the extension, and corresponding to the copper member (7) of the anode, and the cathode is made of a different material, e.g. nickel. Also, sheets of cation-exchange membrane are not fixed to the gaskets associated with the cathode.

The embodiment of FIG. 2 differs from that of FIG. 1 in that in FIG. 2 a single sheet of cation-exchange membrane (13) is positioned over the top of the anode (1)—gasket (8, 9) assembly and positioned on both sides thereof.

The embodiment of FIG. 3 differs from that of FIG. 1 in that a pair of sheets of cation-exchange membrane (14, 15) are positioned one on each side of the anode (1)—gasket (8, 9) assembly and are fixed to the gaskets by means of an adhesive.

Figure 4:
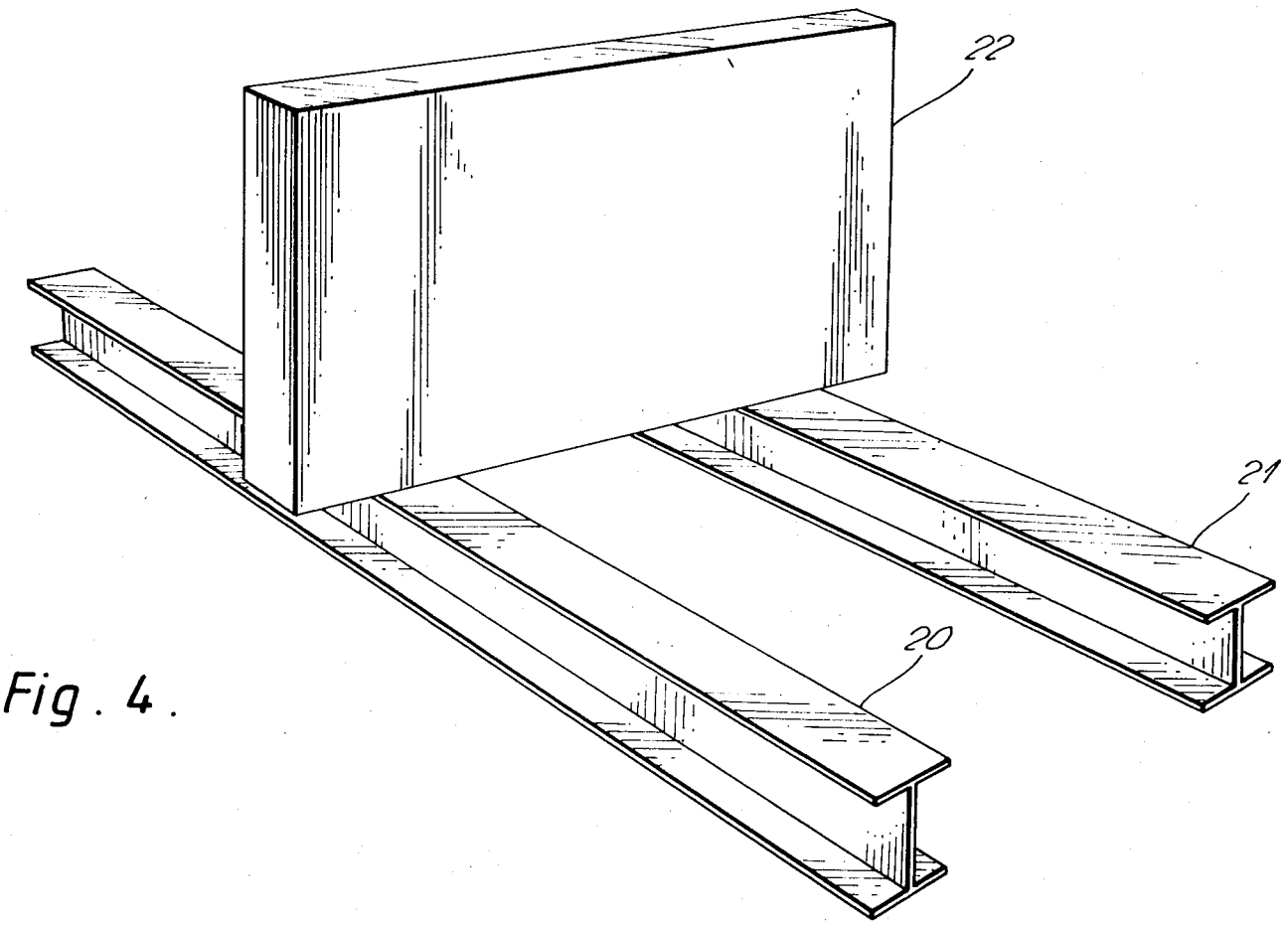

Referring to FIG. 4 there is shown a pair of horizontal support beams (20, 21) on which is bolted a vertical support plate (22).

Figure 5:
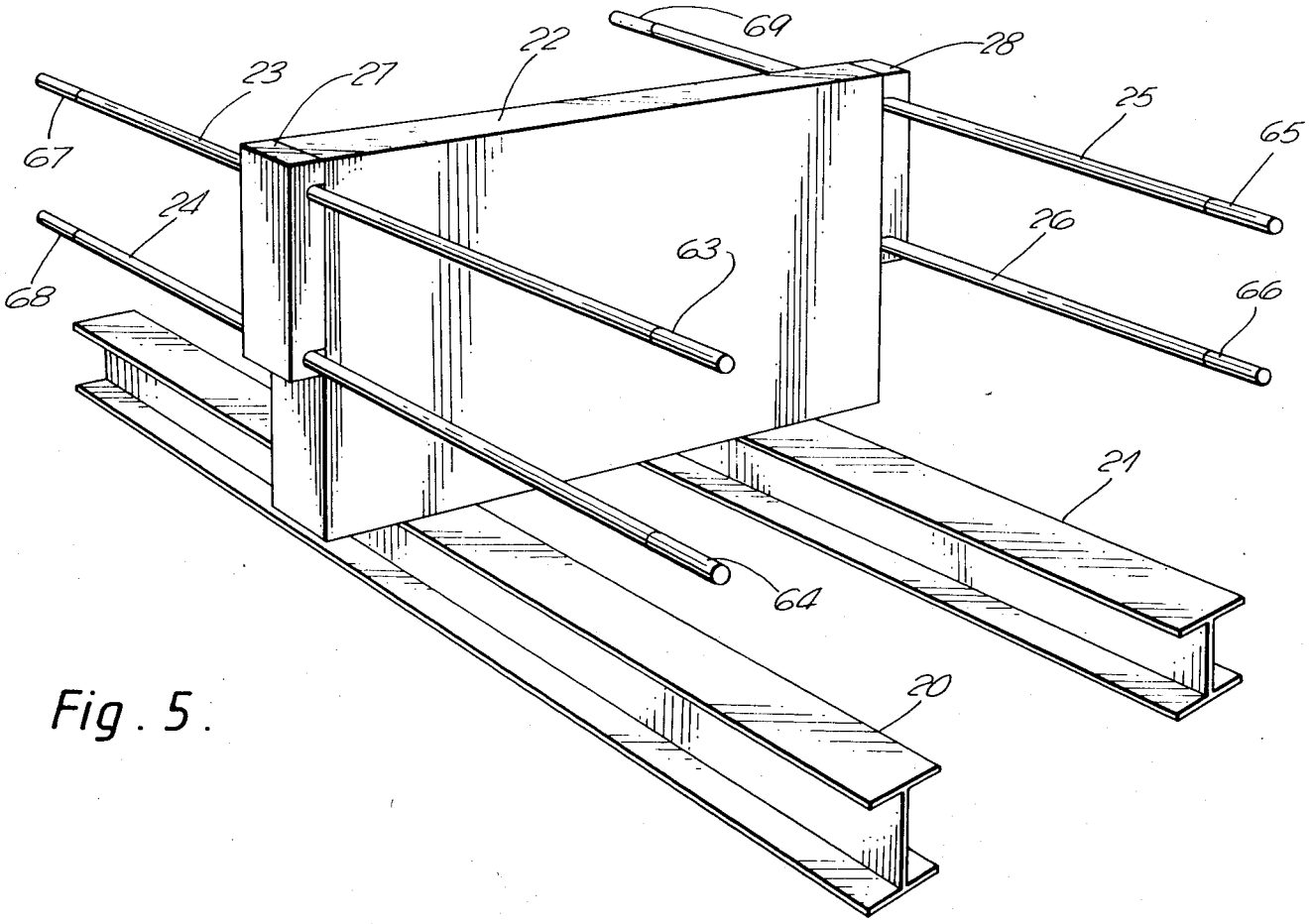

Referring to FIG. 5 there are shown four tie rods (23, 24, 25, 26) positioned in pairs on each side of the support plate (22) and removably fixed thereto by means of notched clamping blocks (27, 28) which blocks are fixed to the support plate (22) by means of bolts (not shown). The tie rods form an integral part of the subsequently assembled cell. The tie rods (23, 24, 25, 26) are fitted with temporary extensions (63, 64, 65, 66, 67, 68, 69, one not shown) to assist in the assembly of the electrolytic cell.

Figure 6:
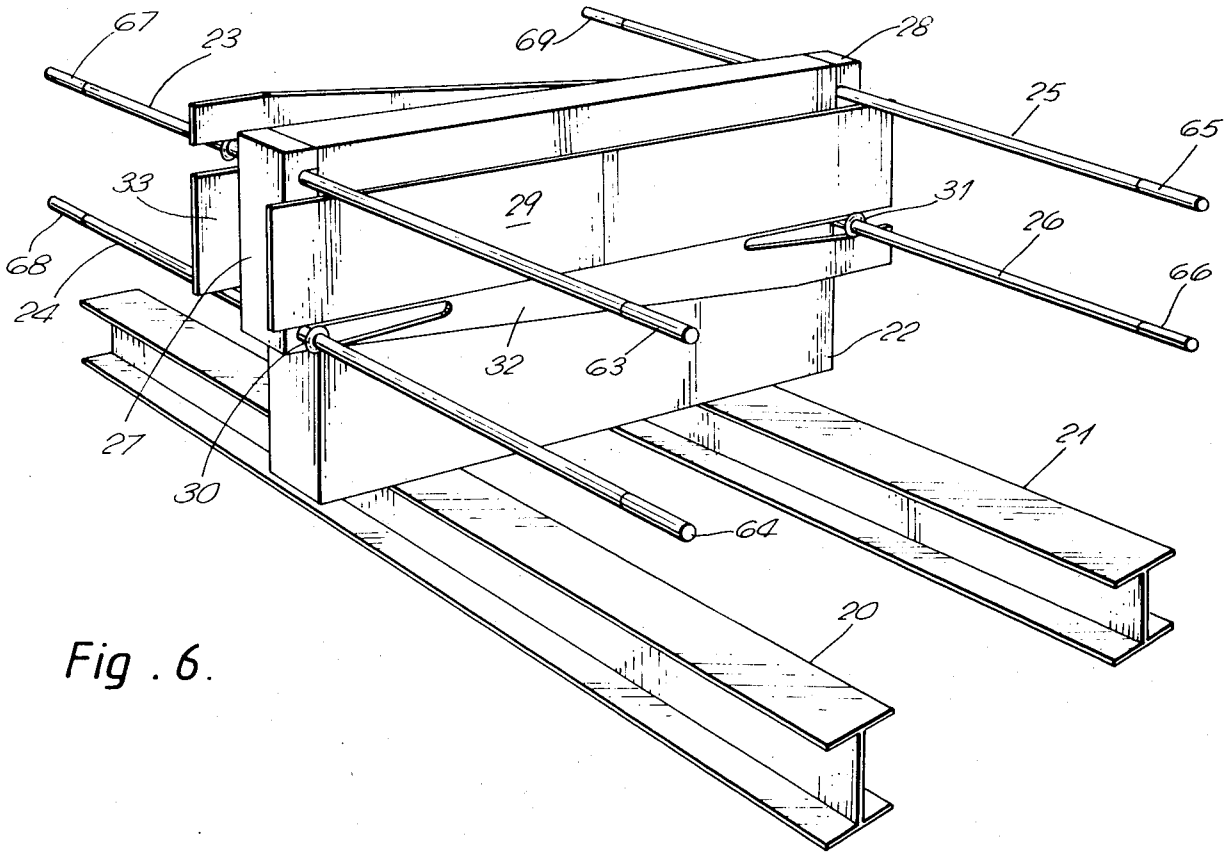

The preliminary stage of assembly of the electrolytic cell is shown in FIG. 6.

A unit (29) shown diagrammatically and comprising an anode and an associated pair of gaskets and a pair of sheets of ion-exchange membrane, as described with reference to FIGS. 1 to 3, is positioned on the lower tie rods (24, 26) through holes (30, 31) in brackets attached to the extension (32) positioned on the lower part of the anode. The holes (30, 31) each carry electrically insulating bushes of polytetrafluoroethylene. On the opposite side of the vertical support plate (22) there is positioned a unit (33) shown diagrammatically and comprising a cathode and an associated pair of gaskets, the unit being positioned on the upper tie rods (23, 25) through holes in brackets attached to the extension on the upper part of the cathode, the holes each carrying electrically insulating bushes of polytetrafluoroethylene.

Thereafter a unit comprising a cathode and associated pair of gaskets is positioned on the upper tie rods (23, 25) adjacent to the anode unit (29), and a unit comprising an anode and associated pair of gaskets and ion-exchange membranes is positioned on the lower tie rods (24, 26) adjacent to the cathode unit (33).

Thereafter the desired number of anode units and cathode units are positioned on the tie rods with each anode unit being positioned adjacent to a cathode unit.

Figure 7:
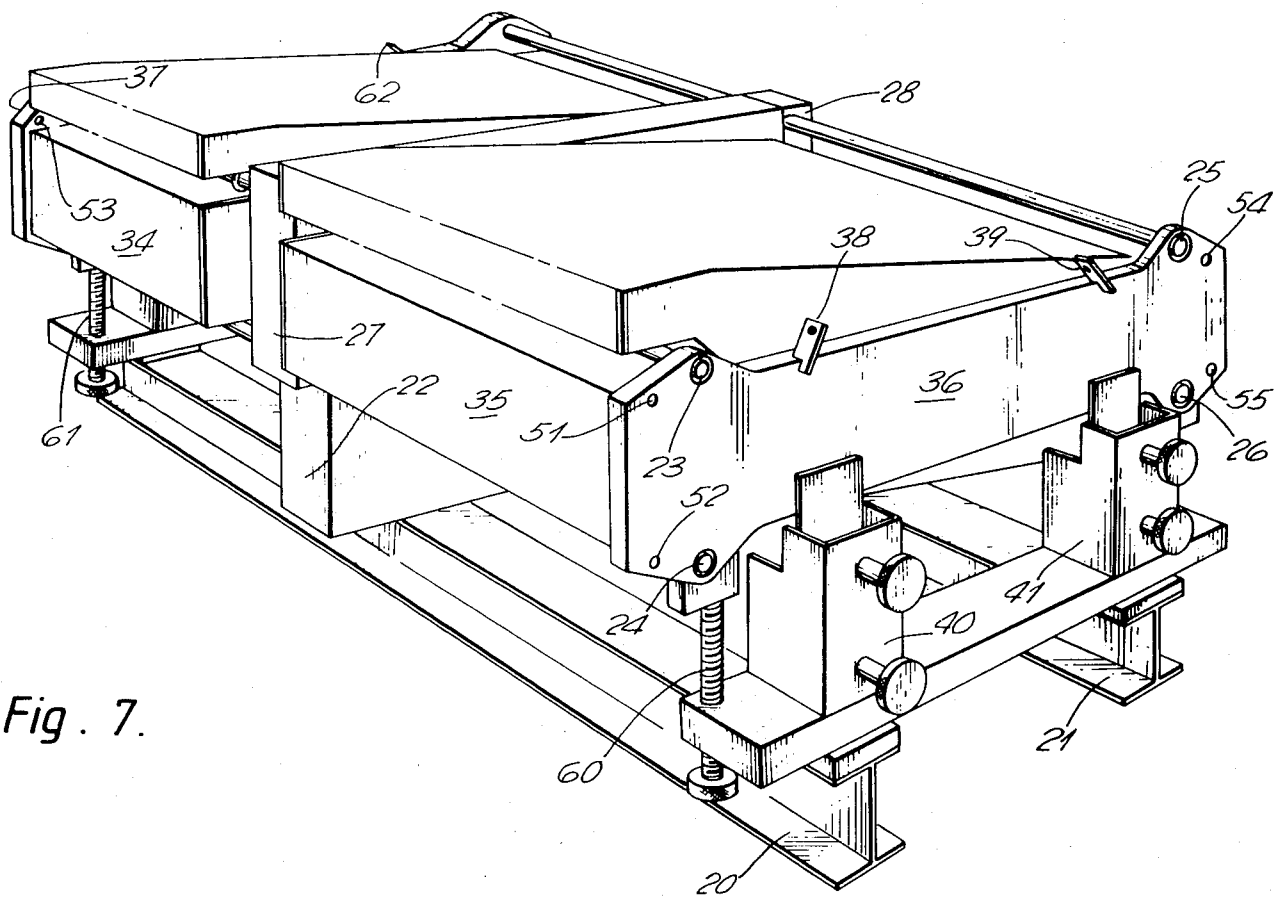

Referring to FIG. 7 the assembly of anode units and cathode units are shown at (34, 35) positioned on either side of the vertical support plate (22). When the desired number of anode units and cathode units have been positioned on the tie rods, end plates (36, 37) are positioned on the tie rods. Each end plate carries lifting lugs (38, 39, 62, one not shown). The end plates (36, 37) are held in position by means of adjustable support means (40, 41) and adjustable support legs (60, 61, two not shown).

Figure 8:
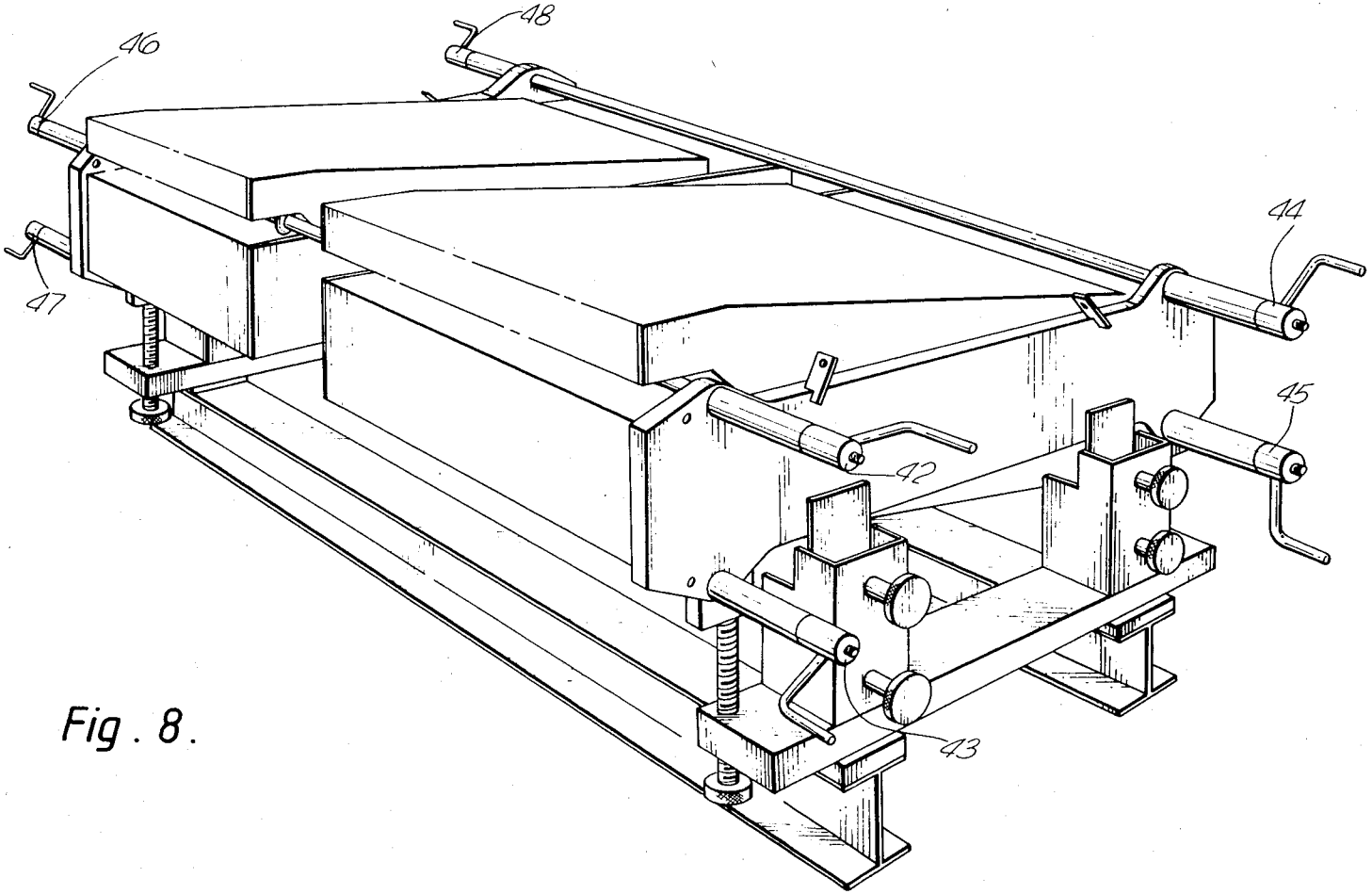

Referring to FIG. 8 screw threaded capstans (42, 43, 44, 45) are positioned on the tie rods at one end thereof, screw-threaded capstans (46, 47, 48, one not shown) are positioned on the other ends of the tie rods, and the support plate (22) and the notched clamping blocks (27, 28) (see FIG. 7) are removed after unbolting the clamping blocks from the support plate.

Figure 9:
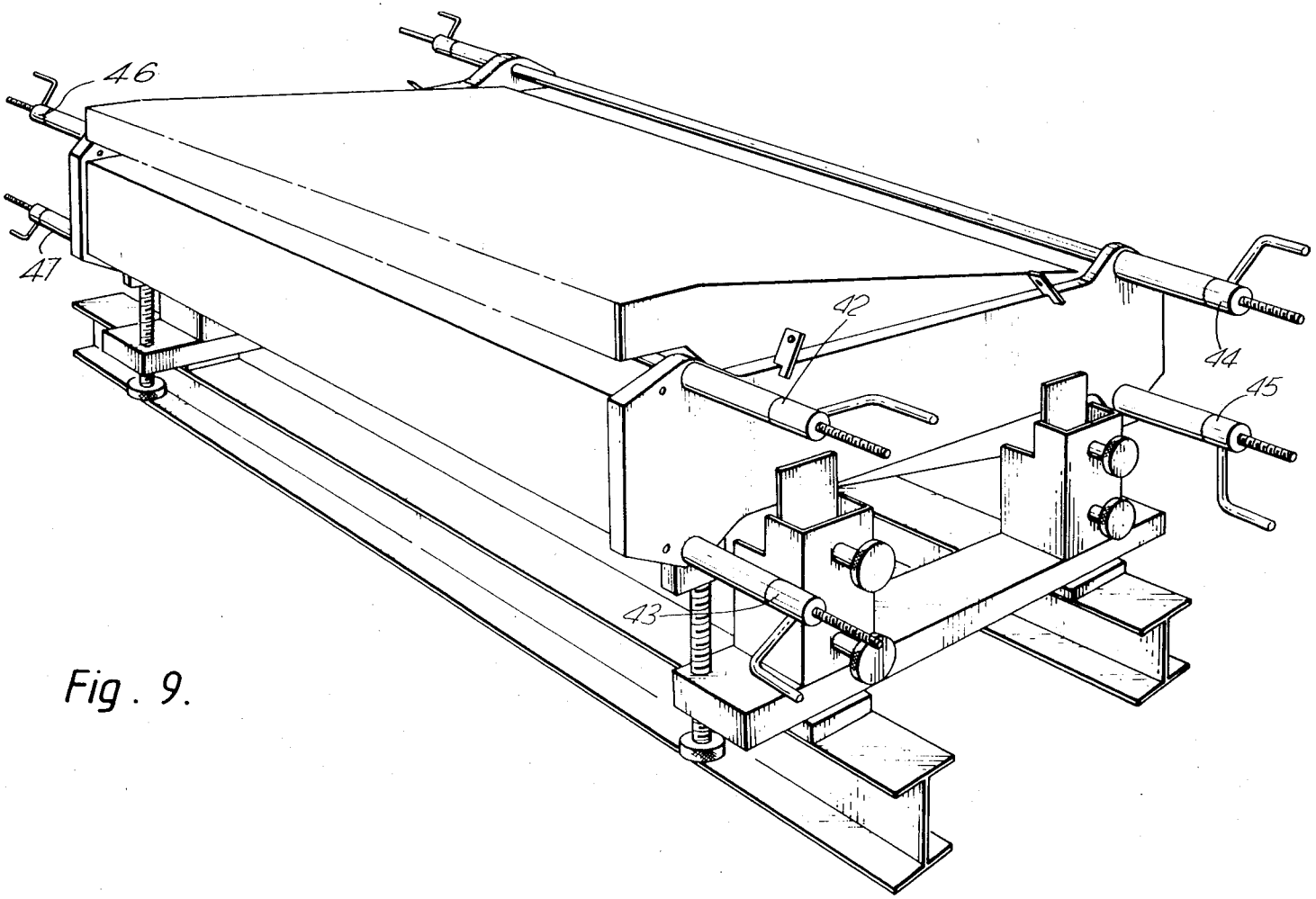

Thereafter the capstans (42, 43, 44, 45) on one end of the tie rods, and the capstans (46, 47, 48, one not shown) on the other end of the tie rods are turned to compress the assembled anodes, cathodes, gaskets and cation-exchange membranes until the desired degree of compression is achieved (see FIG. 9). The degree of compression can be preset by use of suitable spacers.

Figure 10:
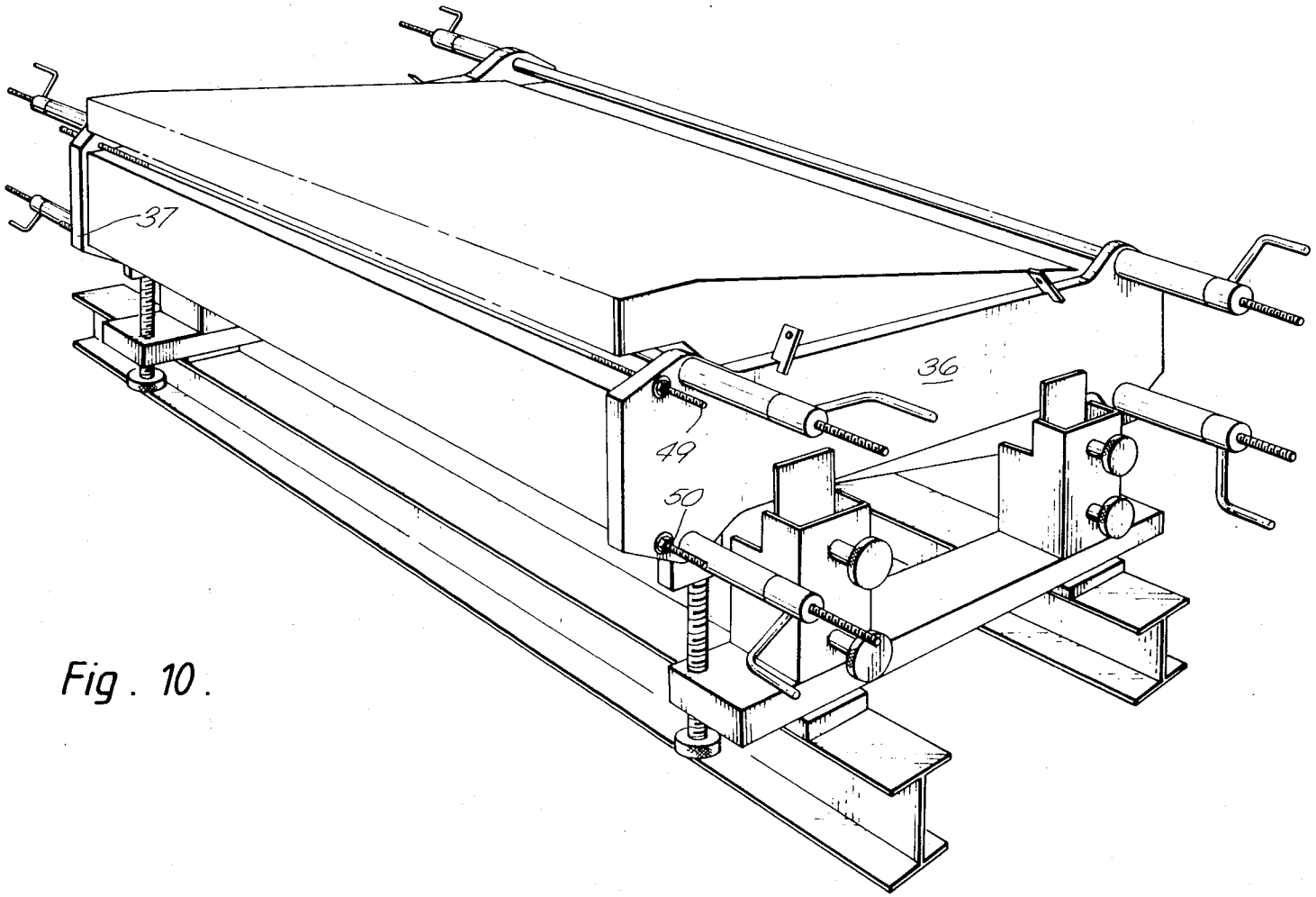
Figure 11:
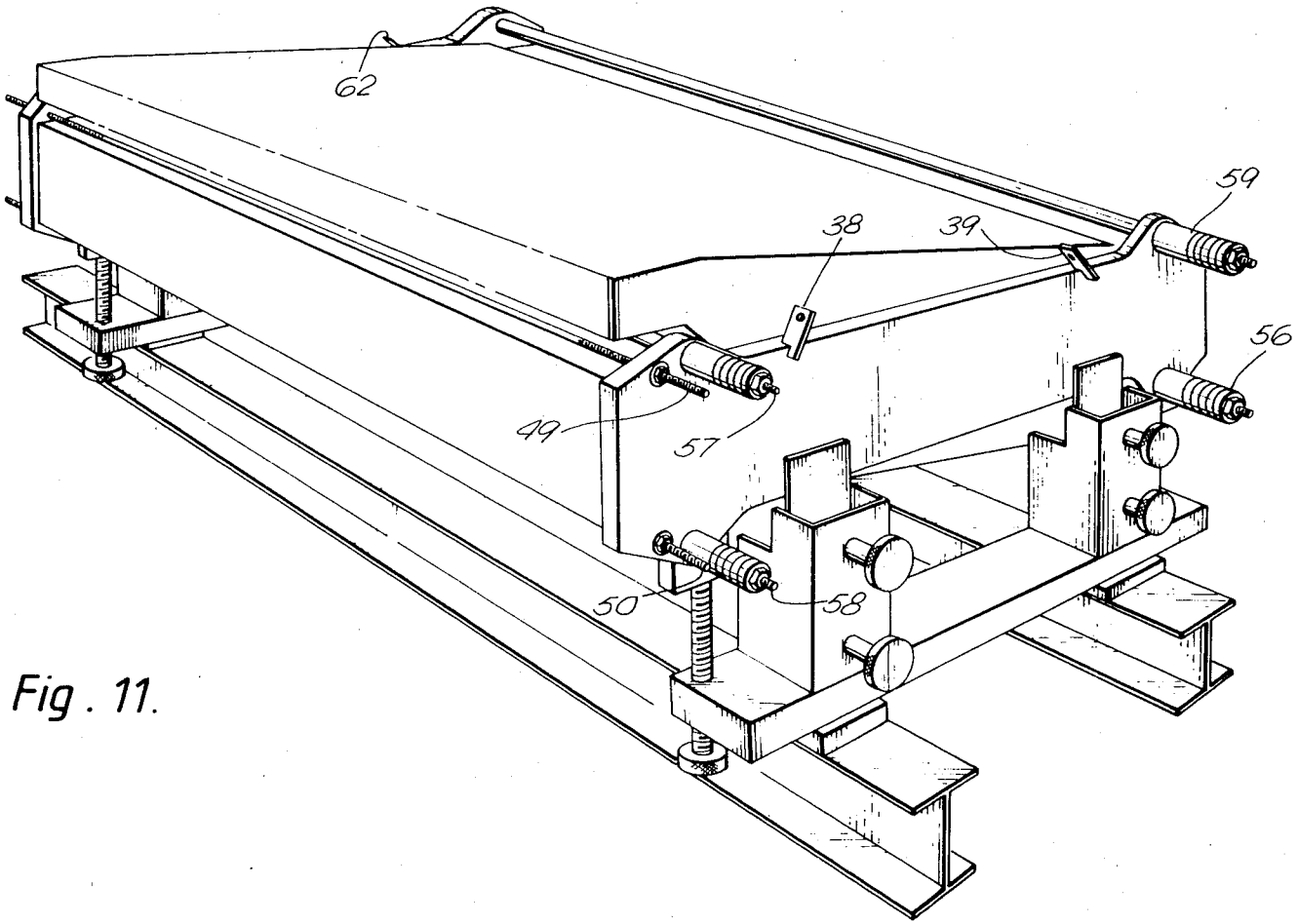
Figure 12:
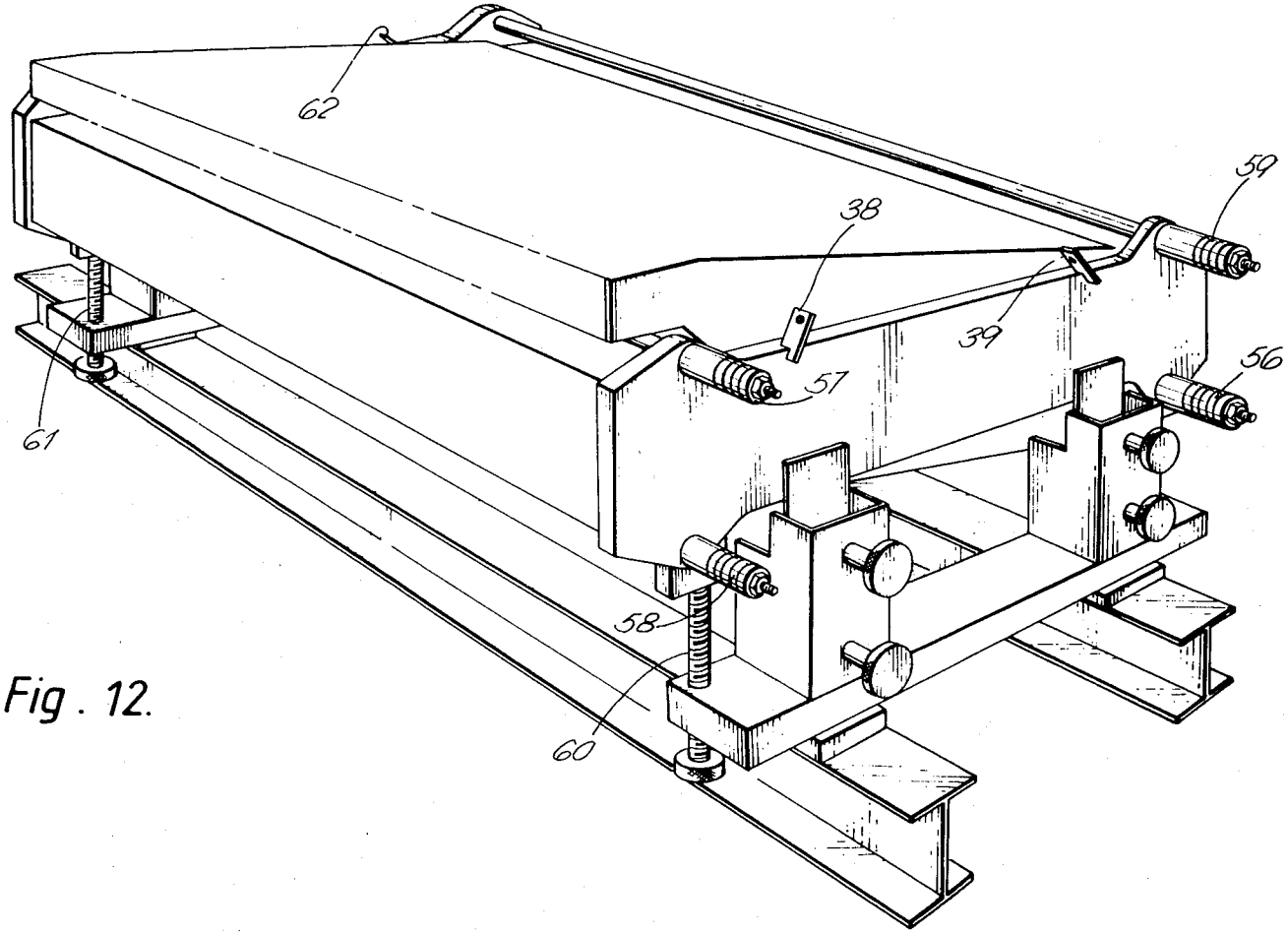

When the desired degree of compression has been achieved temporary fixing rods (49, 50, two not shown) are positioned between the end plates (36, 37) through holes (51, 52, 53, 54, 55, three not shown) (see FIG. 7) in the end plates and bolted thereto (see FIG. 10). Thereafter the capstans and the temporary extensions (63, 64, 65, 66, 67, 68, 69, one not shown) are removed from the assembly and replaced by permanent bolts (56, 57, 58, 59, four not shown) positioned on the ends of each of the tie rods (see FIG. 11), and the temporary fixing rods (49, 50, two not shown) are removed (see FIG. 12).

The completed assembled electrolytic cell may be removed by lifting from the support legs (60, 61, two not shown) via the lifting lugs (38, 39, 62, one not shown).

In use the electrolytic cell is connected to supply means for supply of electrolyte to the anode compartments and for supply of water or other fluid to the cathode compartments, and to means for removal of the products of electrolysis from the anode compartments and cathode compartments, and finally the electrolytic cell is connected to a source of electrical power.

We claim:

1. A method of assembling an electrolytic cell of the filter press type comprising a plurality of anodes, cathodes, gaskets of an electrically insulating material, and separators, said method comprising assembling the electrolytic cell on a jig comprising a support unit having removably affixed thereto a plurality of substantially horizontally disposed support members positioned to at least one side of said unit, wherein said step of assembling the electrolytic cells on the jig includes the steps of vertically positioning the anodes, cathodes and gaskets on said horizontally disposed support members with a separator positioned between an adjacent anode and cathode, removing the support unit, and compressing the thus formed assembly of anodes, cathodes, gaskets and separators on the horizontally disposed support members to form the electrolytic cell.

2. A method as claimed in claim 1 in which the support unit is vertically disposed.

3. A method as claimed in claim 1 or in claim 2 in which the horizontally disposed support members are removably clamped to the support unit.

4. A method as claimed in claim 1 in which the electrolytic cell is a monopolar cell.

5. A method as claimed in claim 1 in which the separators are of the substantially hydraulically impermeable cation-permselective membrane type.

6. A method as claimed in claim 1 in which the separators are affixed to the gaskets.

7. A method as claimed in claim 6 in which the separators are affixed to the gaskets by means of an adhesive.

8. A method as claimed in claim 6 in which the separators are affixed to the gaskets by stapling the separators to the gaskets.

9. A method as claimed in claim 1 in which the anodes and cathodes are positioned on the horizontally disposed support members via apertured members affixed to the anodes and to the cathodes.

10. A method as claimed in claim 1 in which a pre-assembled combination of an anode and a gasket or gaskets, and a pre-assembled combination of a cathode and a gasket or gaskets are positioned on the horizontally disposed support members.

11. A method as claimed in claim 1 in which horizontally disposed support members are positioned to both sides of a vertically disposed support unit.

12. A method as claimed in claim 11 in which each support member is continuous and projects to both sides of the support unit.

13. A method as claimed in claim 11 or claim 12 in which the anodes, cathodes, gaskets and separators are assembled on the support members on both sides of the support unit.

14. An electrolytic cell assembled by a method as claimed in claim 1.

* * * * *